US006704960B1

(12) United States Patent
Lumgair

(10) Patent No.: US 6,704,960 B1
(45) Date of Patent: Mar. 16, 2004

(54) SUPPORT DEVICE

(76) Inventor: George D. Lumgair, 14 Marsabit Street, Pollak Park, Extn. 3, 1559 Springs (ZA)

( * ) Notice: Subject to any disclaimer, the term of this patent is extended or adjusted under 35 U.S.C. 154(b) by 0 days.

(21) Appl. No.: 09/763,999

(22) PCT Filed: Aug. 25, 1999

(86) PCT No.: PCT/IB99/01472

§ 371 (c)(1),
(2), (4) Date: Feb. 26, 2001

(87) PCT Pub. No.: WO00/11989

PCT Pub. Date: Mar. 9, 2000

(30) Foreign Application Priority Data

Aug. 26, 1998 (ZA) ..... 98/7718

(51) Int. Cl.[7] ..... A47C 23/00
(52) U.S. Cl. ..... 5/716; 5/719
(58) Field of Search ..... 5/716, 719, 247, 5/255, 241, 243, 244, 253, 261; 267/168, 85, 89, 180

(56) References Cited

U.S. PATENT DOCUMENTS 3,009,171 A * 11/1961 Rymland ..... 5/252
3,879,025 A * 4/1975 Dillard ..... 267/165
5,426,799 A 6/1995 Ottiger et al. ..... 5/476
5,558,314 A * 9/1996 Weinstein ..... 267/142

FOREIGN PATENT DOCUMENTS

| | | |
|---|---|---|
| DE | 43 24 425 A1 | 1/1995 |
| EP | 0 005 272 A1 | 11/1979 |
| WO | WO 96/22478 | 7/1996 |

* cited by examiner

*Primary Examiner*—Teri Pham Luu
*Assistant Examiner*—Fredrick Conley
(74) *Attorney, Agent, or Firm*—Sheridan Ross PC

(57) ABSTRACT

A support device (10) includes a plurality of interconnected support units (12) arranged in a matrix. Each support unit (12) includes a plurality of support elements (16) configured to deform laterally outwardly when the support unit (12) is subjected to a compressive load in a load direction (54). A pre-compression is induced in the support units (12) by laterally pre-tensioning the support units (12) by means of springs (25) connected to a peripheral frame. Hence, when a support unit (12) is subjected to a compressive load in the load direction (54) it expands laterally which serves to relieve, at least partially, the pre-tension in the support units (12) connected thereto which then extend in the load direction under the influence of the springs (24).

13 Claims, 4 Drawing Sheets

SUPPORT DEVICE

When irregularly shaped objects are supported on a resilient surface, the surface becomes irregularly loaded, resulting in excessive supportive pressure on parts typically prominent parts of the object, and insufficient support on other parts typically less prominent parts of the object.

According to one aspect of the invention there is provided a support device which includes a plurality of resiliently deformable support units each of which has a pre-compression induced in a load direction, the support units being arranged such that further compression of one support unit in the load direction will cause a reduction in compression of an adjacent support unit.

The support units may be interconnected and the pre-compression is induced by laterally pre-tensioning the support units.

According to another aspect of the invention there is provided a support device which includes a plurality of resiliently deformable support units each of which is laterally connected to at least one other support unit and being configured such that when subjected to a compressive load in a load direction, it deforms laterally in a manner which induces an extensile loading of the at least one other support unit to which it is connected.

The term "connected" is to be understood to include an arrangement where load transmission between the support units occurs and includes for example where adjacent support units butt against each other, have a positive mechanical connection, or the like.

Each of the support units may be pre-tensioned laterally such that increased compression of one support unit in the load direction will cause a reduction in compression of the at least one other support unit to which it is connected.

The support units may be pre-tensioned by laterally pre-tensioning the support device, e.g. in a peripheral frame. Instead, or in addition, the support units may be pre-tensioned interdependently against each other and/or against internal spacers.

Each support unit may include a pair of ends spaced apart in the load direction and at least one elongate support element extending between the ends and configured to buckle laterally in a predetermined direction when the support unit is subjected to a compressive load in the load direction.

Interconnected support units may be connected together via their support elements, interconnected support elements being configured to buckle in opposite directions usually towards each other.

In one embodiment of the invention the interconnected support elements of interconnected support units may be connected together via connecting members extending laterally between the support elements. The connecting members may be articulated to the support elements. The connecting members may be in the form of struts, preferably, however, the connecting members are flexible and inelastic.

In another embodiment of the invention the interconnected support elements of interconnected support units may be connected directly to one another, e.g. by laterally bearing against each other.

The support device may be a unitary moulding of an elastomeric material.

Each support unit may include a plurality of support elements forming a resilient articulated frame. Each frame may define an octahedron, the support unit including four support elements, each of which has two angularly spaced limbs or parts defining two edges of the octahedron and being configured to deform laterally outwardly when the support unit is subjected to a compressive load in the load direction, the support elements being biased against outward buckling by resilient tensile elements spanning the octahedron internally. The two parts of each support element may be articulated. Preferably the included angle defined between the parts or limbs of a support element is obtuse.

The support device may include a plurality of the support units arranged in an interconnected matrix.

The support device may include at least two layers of support units superimposed one upon the other in the load direction.

The support device may be in the form of a mattress.

The invention will now be described, by way of example, with reference to the accompanying diagrammatic drawings.

Figure 1:
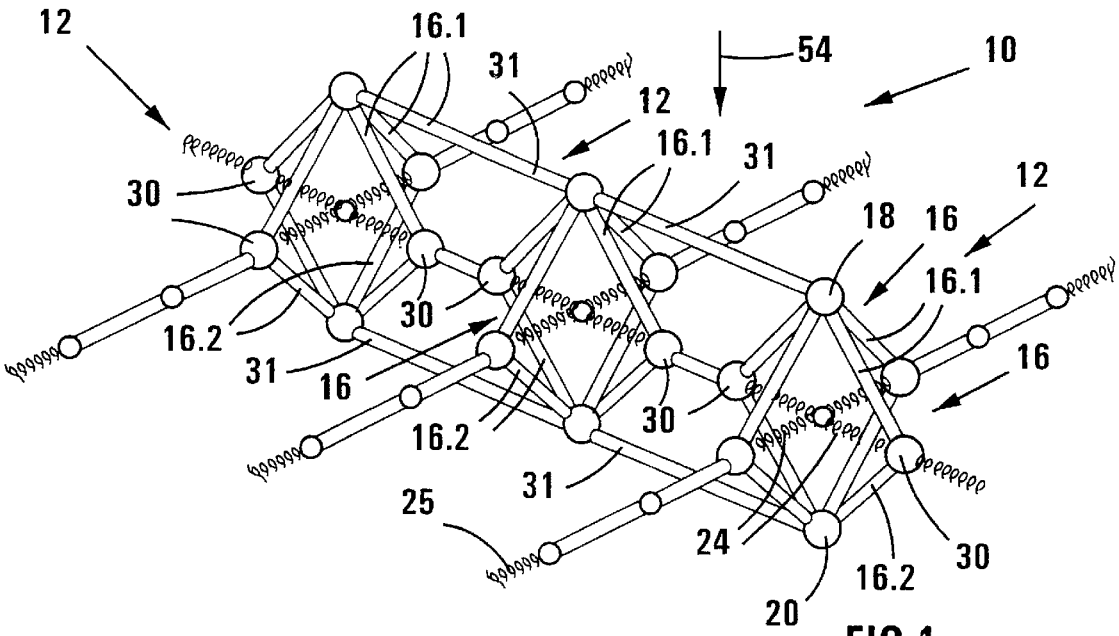
FIG. 1 shows a three-dimensional view of part of a first embodiment of a support device in accordance with the invention.

Referring to FIG. 1 of the drawings, reference numeral 10 refers generally to part of a first embodiment of a support device in accordance with the invention.

The support device 10 comprises a plurality of support units 12, arranged in a matrix (part of which shown in FIG. 1 of the drawings). Each support unit 12 includes four support elements 16 spanning between an upper end 18 and a lower end 20. Each support element 16 includes two angularly spaced parts or limbs, namely an upper part 16.1 and a lower part 16.2 which are articulated to buckle at a corner or outer joint 30. The support elements 16 are arranged such that their parts 16.1, 16.2 lie along the edges of an octahedron. The ends of the parts 16.1, 16.2 of the support elements 16 are all articulated to permit their relative displacement as described in more detail herebelow.

Resilient tensile members in the form of coil springs 24 span the support unit 12 between opposing corners or outer joints 30, to bias the support elements 16 against outward buckling.

Adjacent support units are interconnected by connecting members 14 and by connecting members 31 extending between the upper ends 18 and lower ends 20. The connecting members 14 and connecting members 31 are articulated to the support units 12. The connecting members 14 are typically flexible and inelastic.

The outer joints 30 of the matrix are connected to a supporting frame (not shown) through resilient members in the form of springs 25. The tension in the springs 25 is selected so as expand the matrix in a lateral plane perpendicular to the load direction which serves to urge the joints 30 outwardly and thereby tension the springs 24. This in turn causes a lateral pretension in each of the support units 12 which tends to reduce the height of the support units 12 in the load direction, i.e. the spacing between the upper end 18 and lower end 20 decreases.

A suitable support surface, e.g. the cover of a mattress, will be positioned over the support device. If an uneven or irregularly shaped load is placed on the support surface the load is carried on the support units 12 in a manner in which those support units 12 which are more heavily loaded tend to be compressed in the direction of arrow 54. This compression of a support unit causes the joints 30 to be urged outwardly against the bias of the springs 24. This outward displacement reduces the tension in the connecting members 14 connecting the adjacent joints 30 thereby tending to reduce the lateral pre-tension in the adjacent less heavily loaded support unit 12 and permit the support unit 12 to extend in the load direction under the inward bias of the springs 24 or at least to exert an upwardly directed, i.e. in a direction opposite to the direction of arrow 54, load on any externally imposed surface loads.

As a result, heavily loaded areas of the support device 10 tend to be compressed and lesser loaded areas tend to extend providing added support over the lesser loaded areas.

The Inventor believes that the support device 10 will find application particularly, but not necessarily exclusively, in a mattress to support a prone person. In use, the mattress will have heavily loaded areas carrying the shoulders and hips of the person lying on the mattress compressed which will allow the structures in lesser loaded areas to extend. This extension provides for areas of the body such as the lower back and the neck to receive added support.

In this way, the Inventor believes that a mechanical arrangement which approximates the support offered by a waterbed is provided. This accordingly provides the advantages of support that a waterbed provides over a conventional sprung mattress without the disadvantages of high weight, regular maintenance and the like.

Figure 2:
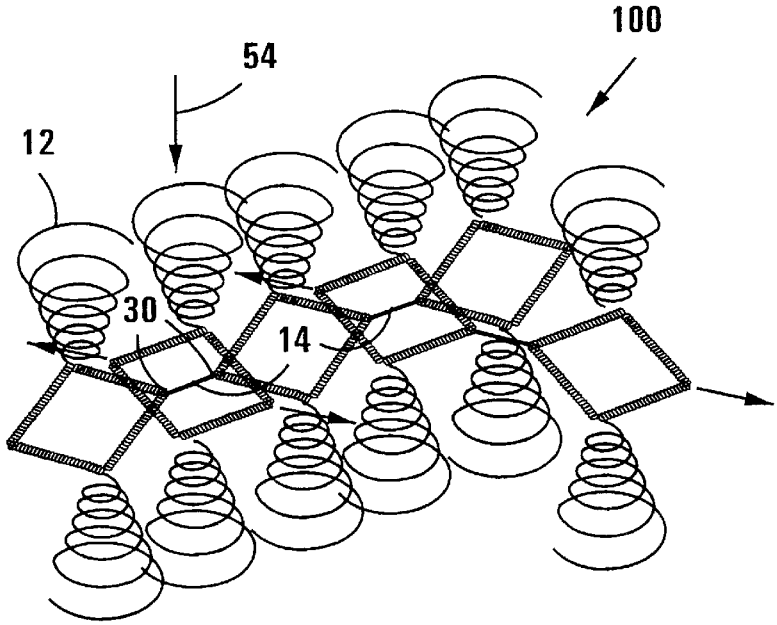
FIG. 2 shows a three-dimensional view of part of a second embodiment of a support device in accordance with the invention.
Figure 3:
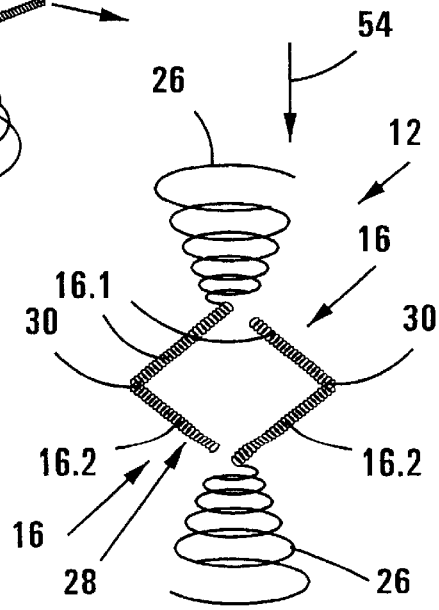
FIG. 3 shows a support unit of the support device of FIG. 2.

Reference is now made to FIGS. 2 and 3 of the drawings, in which reference numeral 100 refers generally to part of a second embodiment of a support device in accordance with the invention and, unless otherwise indicated, the same reference numerals used above are used to designate similar parts.

In this embodiment of the invention, each support unit 12 includes opposing tapering coil springs 26, each tapering in the load direction 54 into a support element 16 which is straight prior to assembly of the support unit. Hence, a support unit 12 comprises two opposing one-piece composite elements 16,26 connected together at the extremities of the support elements 16. When the support unit 12 is laterally tensioned at the midpoints 30 of the support elements 16, the support elements 16 deform outwardly to form a parallelogram formation 28. Each support element 16 is in the form of a relatively stiff coil spring which, as mentioned above, is formed integrally with the spring 26. Further bowing and buckling occurs in the direction of pre-tensioning when the support element is subjected to a compressive load in the load direction. Flexible inelastic members 14 interconnect midpoints 30 of support units 12, the support units 12 being arranged in a laterally extending matrix and alternating support units being connected in a first lateral direction and intermediate support units 12 being connected in a second lateral direction at an angle, typically perpendicular, relative to the first lateral direction.

The support device 100 is used in similar fashion to the support device 10 and, if desired, can be pre-tensioned, e.g. in a peripheral support frame in the manner described above with reference to FIG. 1.

Figure 4:
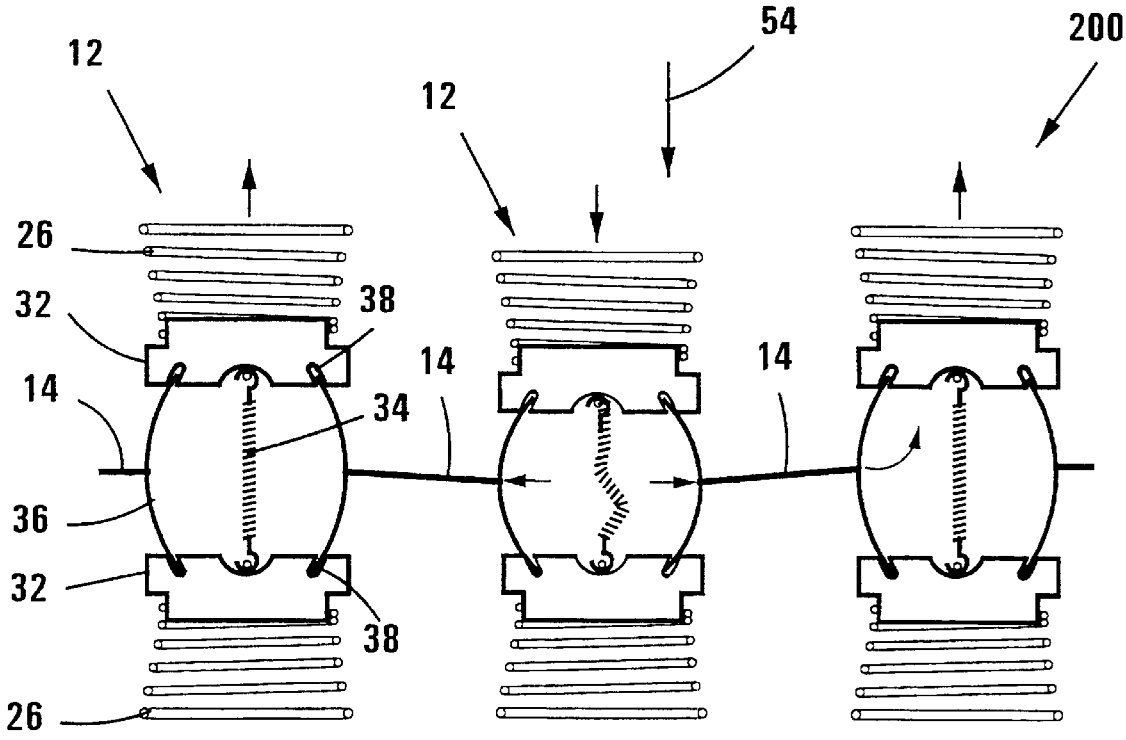
FIG. 4 shows a side view of part of a third embodiment of a support device in accordance with the invention.
Figure 5:
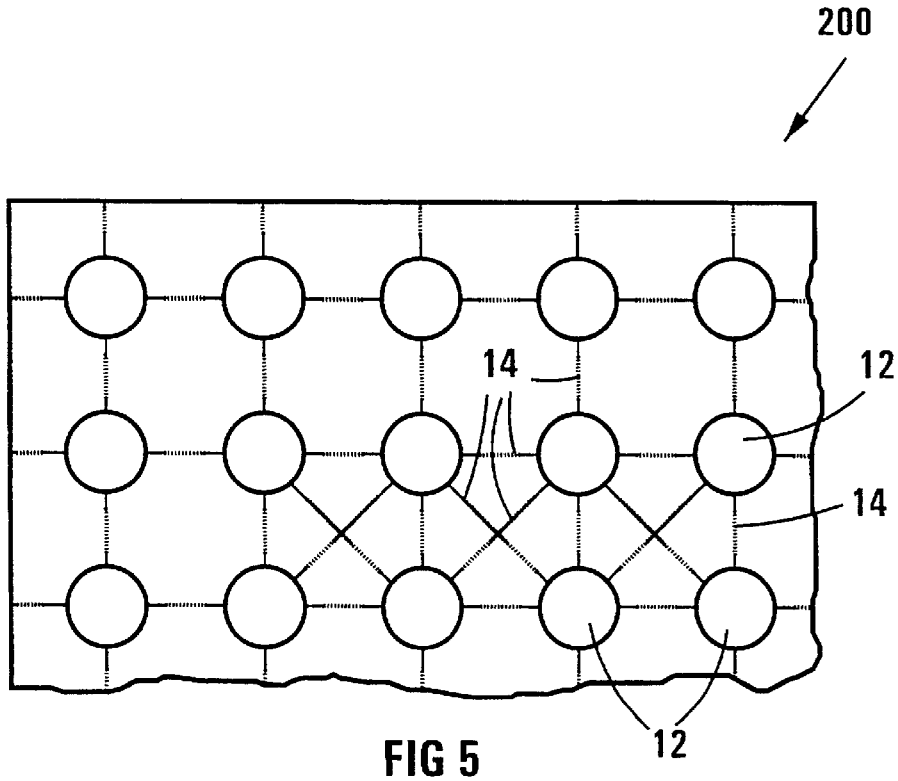
FIG. 5 shows a top plan schematic view of part of the support device of FIG. 4.

Reference is now made to FIGS. 4 and 5 of the drawings, in which reference numeral 200 refers generally to part of a third embodiment of a support device in accordance with the invention and, unless otherwise indicated, the same reference numerals used above are used to designate similar parts.

In this embodiment of the invention, each support unit 12 includes opposing tapering coil springs 26, each seated on a seat member 32. The upper and lower seat members 32 of each support unit are convergently biased in the load direction by a coil spring 34 under tension. Circumferentially spaced resiliently deformable support elements 36 span between the seat members 32, each support element 36 being bent such that it bows outwardly. The bowed support elements 36 exert an effort on the seat members 32 in a direction opposite to that of the coil spring 34 to maintain the tension in the coil spring 34. Compression of the support units 12 in the load direction 54 results in further outward bowing of each of the support elements 36. The coil springs 34 hold the seat members 32 of each support unit 12 together by retaining each support element 36 in a bent pre-compressed condition between seat formations 38 defined in each seat member 32. Adjacent support units 12 are interconnected by connecting members 14 spanning between adjacent support elements 36 of adjacent support units 12. The support elements 36 will typically be of spring steel or the like and the connecting members 14 will be flexible and inelastic or of limited elasticity.

As can best be seen in FIG. 5 of the drawings, each support unit 12 is connected to adjacent support units 12 to form a laterally extending network or matrix of perpendicularly and diagonally interconnected support units 12 interconnected by connecting members 14.

The coil springs 26 may be connected by lacing wires (not shown) in the normal manner found in spring mattresses and the support device 200 will act to support a prone person in the manner described above.

It will of course be appreciated that the coil springs 26 could be included in the kind of support structure described and illustrated in FIG. 1 .

If desired, cross-linked support elements 36 may be included for better stability and transmission of movement from one support unit to those adjacent to it.

If desired, the support units can be mounted and pre-tensioned in a peripheral frame as described above.

Figure 6:
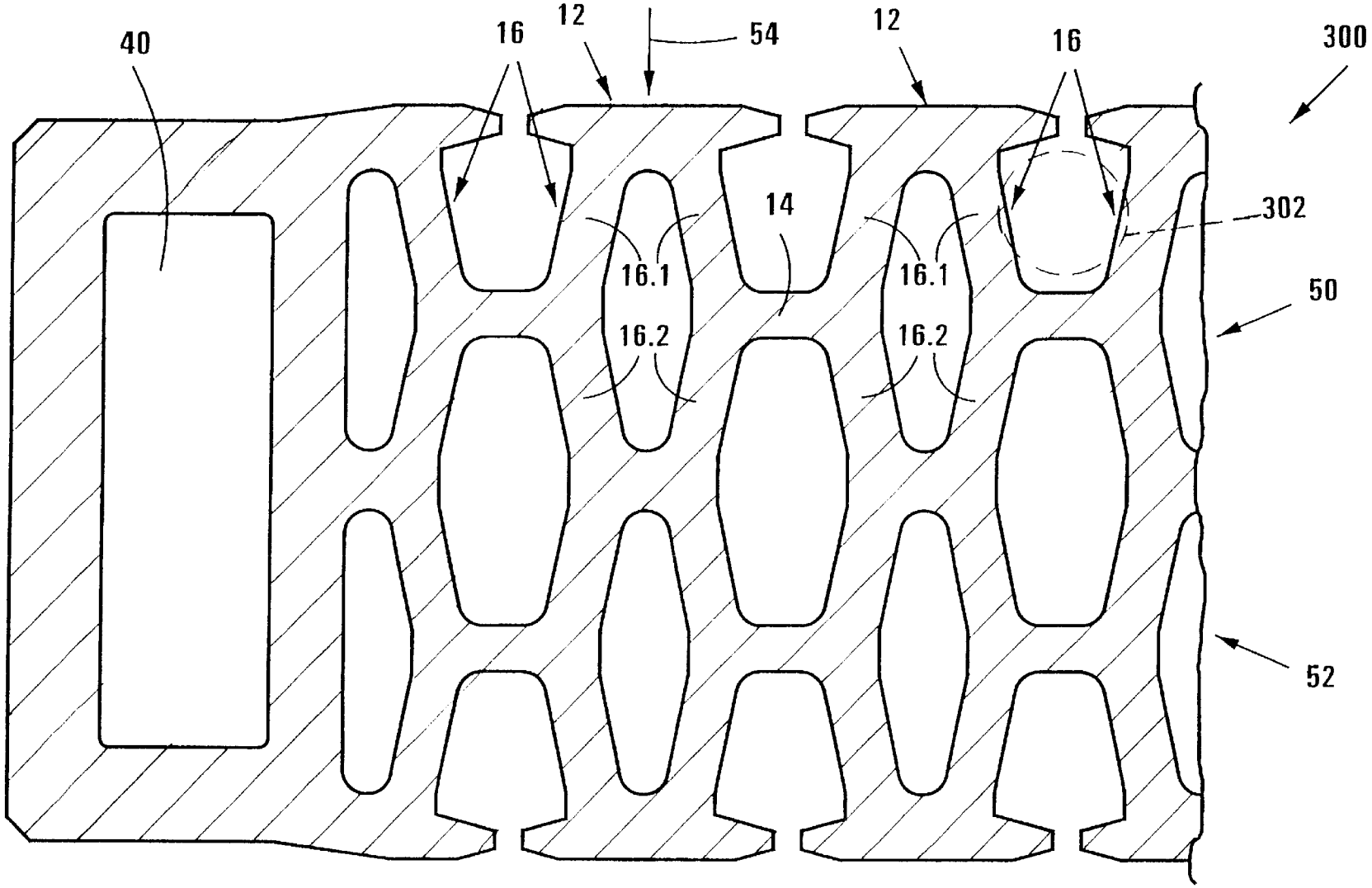
FIG. 6 shows a sectional side view of part of a fourth embodiment of a support device in accordance with the invention.

Reference is now made to FIG. 6 of the drawings, in which reference numeral 300 refers generally to part of a fourth embodiment of a support device in accordance with the invention and, unless otherwise indicated, the same reference numerals used above are used to designate similar parts.

The support device 300 is formed as a unitary moulding of a resilient elastomeric material. The support device 300 includes support units 12 each of which includes support elements 16 which are bowed outwardly and are connected to support elements of adjacent support units 12 via integrally moulded connecting members 14. The support device 300 includes two layers 50,52 of support units 12, integrally formed on top of each other in the load direction.

It will be appreciated that the moulding is three-dimensional and that each support unit 12 includes a plurality of the support elements 16 arranged to approximate an octahedron in a similar fashion to the embodiment described above with reference to FIG. 1 of the drawings.

A hollow passage 40 is defined at the periphery of the support device 300. If desired, a peripheral support frame (not shown) with length and breadth dimensions somewhat larger than that of the moulding may be mounted in the passage 40 in order to laterally stretch the moulding and thus provide a pre-tension to the support units 12 in the manner described above. In this embodiment of the invention, when one of the support units 12 is compressed in the load direction, the lateral expansion of the support unit 12 permits a reduction in the pre-tension in the adjacent support units 12, as well as a corresponding lateral contraction. Further, when the support units 12 are pretensioned the lateral contraction of a support unit as a result of the reduction in the pre-tension permits the support unit 12, by virtue of the memory of the material, to extend in the load direction.

If desired, instead of or in addition to the peripheral frame mounted in the passage 40, spheres 302 or other suitably shaped oversized spacers can be used to pre-tension the moulding laterally by wedging in position as shown in broken lines in FIG. 6 of the drawings. By positioning a plurality of the spacers 302 between adjacent support units 12, the support units 12 can be laterally pre-tensioned. The support elements 16 of adjacent support units 12 will typically be connected to the spacers 302 at diametrically opposed positions such that compression of one support unit 12 in the load direction 54 will cause an extensile loading of the adjacent support unit 12 facilitated by the rotational motion of spherical spacer 302.

Naturally, the support units 12 can be connected in any suitable fashion.

Figure 7:
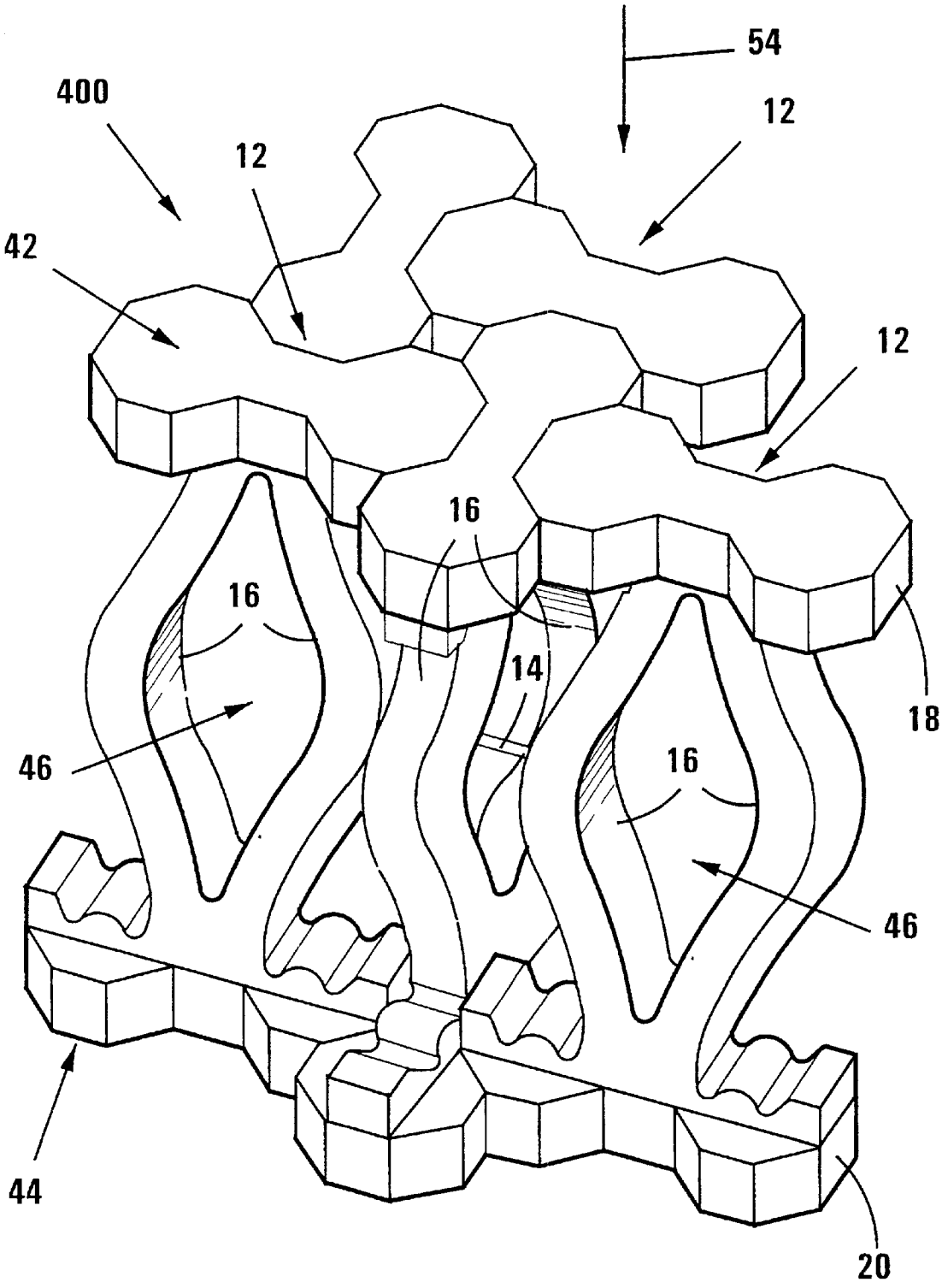
FIG. 7 shows part of a fifth embodiment of a support device in accordance with the invention.

Reference is now made to FIG. 7 of the drawings, in which reference numeral 400 refers generally to part of a fifth embodiment of a support device in accordance with the invention and, unless otherwise indicated, the same reference numerals used above are used to designate similar parts. The support device 400 consists of a plurality of laterally abutting support units 12. Each support unit 12 is an integral moulding including an upper end 18, a lower end 20 and two slightly bowed support elements 16 extending between the upper end 18 and lower end 20. The upper end 18 and lower end 20 of each support unit 12 has a "dog-biscuit" or "hourglass" shape in plan view, thereby permitting adjacent support units 12 to be arranged in a "basket weave" arrangement and defining a substantially continuous upper face 42 and a substantially continuous lower face 44. Each support unit 12 includes an integrally formed engagement formation (not shown) releasably receivable in complementary engagement formations of an adjacent support unit 12 to retain the support units 12 in a desired spacial arrangement. Each pair of support elements 16 of one support unit 12 is curved laterally outwardly, such that compression of the support unit 12 in the load direction 54 results in outward buckling of the support elements 16 and thus transverse expansion of the support unit 12. Support units 12 having the same orientation in the basket weave pattern, are interconnected by flexible inelastic connecting members 14 connecting the support elements 16 of one support unit 12 to the support elements 16 of other adjacent support units 12. The members 14 are configured such that they cause the interconnected support elements 16 to bow further and hence to cause the support units 12 to become pre-tensioned. Alternatively, a support element 16 of one support unit 12 may butt directly against a support element 16 of another support unit 12.

As shown in FIG. 7 of the drawings, the members 14 or the abutting arrangement of support elements 16 extends through a central aperture 46 defined between the support elements 16 of an adjacent support unit 12 having an orientation different from and positioned between the interconnected support units 12.

Once again, the support device 400 utilizes the properties of resiliency or material memory, causing the tendency of a lessor loaded support unit 12 to tend to return to its unloaded shape due to a reduction in the pre-tension on it when a relatively greater load is imposed in the load direction on an adjacent interconnected support unit 12.

It will be appreciated that many variations in structure will be possible without departing from the scope of the invention.

The Inventor believes that a support device in accordance with the invention will provide a relatively even support to an irregularly shaped object which enables the support provided by a waterbed to be simulated by a mechanical arrangement.

What is claimed is:

1. A support device which includes a plurality of resiliently deformable support units each of which has a pre-compression induced in a load direction, the support units being laterally interconnected such that further compression of one support unit in the load direction, will cause a reduction in pre-compression of an adjacent support unit.

2. A support device as claimed in claim 1, in which the pre-compression in the support units is induced by laterally pre-tensioning the support units.

3. A support device as claimed in claim 1, in which each support unit includes a pair of ends spaced apart in the load direction and at least one elongate support element extending between the ends and configured to buckle laterally in a predetermined direction when the support unit is subjected to a compressive load in the load direction.

4. A support device as claimed in claim 3, in which interconnected support units are connected together via their support elements, interconnected support elements being configured to buckle in opposite directions.

5. A support device as claimed in claim 4, in which the interconnected support elements of interconnected support units are connected together via connecting members extending laterally between the support elements.

6. A support device as claimed in claim 5, in which the connecting members are articulated to the support elements.

7. A support device as claimed in claim 4, in which the interconnected support elements of interconnected support units are connected directly to one another.

8. A support device as claimed in claim 1, which is a unitary moulding of an elastomeric material.

9. A support device as claimed in claim 1, in which each support unit includes a plurality of support elements forming a resilient articulated frame.

10. A support device as claimed in claim 9, in which each frame defines an octahedron, the support unit including four support elements, each of which has two angularly spaced limbs defining two edges of the octahedron and being configured to deform laterally outwardly when the support unit is subjected to a compressive load in the load direction.

11. A support device as claimed in claim 1, which includes a plurality of the support units arranged in a matrix.

12. A support device as claimed in claim 1, which includes at least two layers of support units superimposed one upon the other in the load direction.

13. A support device as claimed in claim 1, which is in the form of a mattress.

* * * * *